United States Patent [19]

Laliberte

[11] 4,047,397

[45] Sept. 13, 1977

[54] CROCHET NEEDLE WITH CUTTING MEANS

[76] Inventor: Shirley P. Laliberte, 2724 E. Main St., Waterbury, Conn. 06705

[21] Appl. No.: 683,464

[22] Filed: May 5, 1976

[51] Int. Cl.[2] ..... D04B 3/02

[52] U.S. Cl. ..... 66/118; 66/1 A

[58] Field of Search ..... 66/1 A, 117, 118, 121, 66/14, 145 R, 147, 123, 4

[56] References Cited

U.S. PATENT DOCUMENTS

| | | | |
|---|---|---|---|
| 268,442 | 12/1882 | Wahl | 66/118 |
| 1,303,327 | 5/1919 | Jensen | 66/118 |
| 1,355,878 | 10/1920 | Akin | 66/118 |
| 1,502,584 | 7/1924 | Perry | 66/118 |
| 1,524,328 | 1/1925 | Wolverton | 66/117 |
| 2,635,444 | 4/1953 | Carlson | 66/118 |

FOREIGN PATENT DOCUMENTS

| | | | |
|---|---|---|---|
| 862,825 | 3/1941 | France | 66/117 |
| 1,827 of | 1901 | United Kingdom | 66/118 |
| 5,507 of | 1911 | United Kingdom | 66/118 |

*Primary Examiner*—Mervin Stein
*Assistant Examiner*—Andrew M. Falik
*Attorney, Agent, or Firm*—McCormick, Paulding & Huber

[57] ABSTRACT

A crochet needle having a conventional hook and integral body portion and a cut off device at an end opposite the hook. The cut off device comprises a blade with a sharpened edge which is concealed within a second hook, which is displaced 180° from the crocheting hook. The edge of the blade is spaced inwardly from the mouth of the cut off hook so as not to form a hazardous device which might injure the hand or finger of the user.

10 Claims, 5 Drawing Figures

CROCHET NEEDLE WITH CUTTING MEANS

BACKGROUND OF THE INVENTION

Various designs for crochet needles have been in common use and separate cut off devices have also been provided in the past. Alternative use of the crocheting hook and an integral cut off device, however, has not been provided for in a ready and convenient manner. It has been necessary to disengage the crocheting hook, place the needle at rest, then to pick up and to manipulate the separate cut off device in severing the thread, yarn, etc.

SUMMARY OF THE INVENTION

It is the general object of the present invention to provide an improved crochet needle which includes an integral cut off device which may be easily and conveniently employed on a mere reversal of attitude of the needle.

DESCRIPTION OF THE PREFERRED EMBODIMENTS

Figure 1:
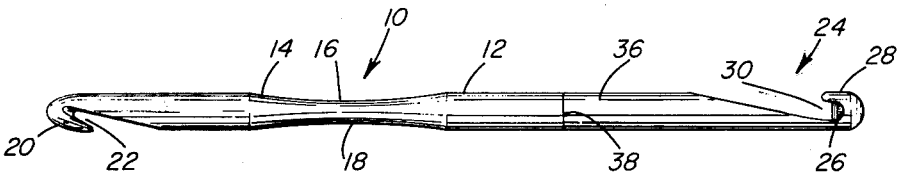
FIG. 1 is a side elevational view of the improved crochet needle of the present invention.
Figure 2:
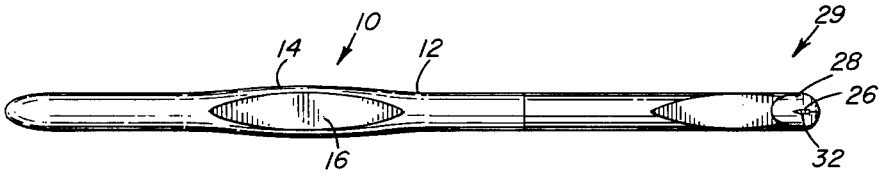
FIG. 2 is a top view of the crochet needle.

Referring particularly to FIGS. 1 and 2, it will be observed that a crochet needle indicated generally at 10 has a central body portion 12 which is or may be conventional in form. That is, the body portion 12 is elongated and has a generally smooth arcuate surface for manual gripping and manipulation. As illustrated, the body portion 12 is of circular cross section throughout a major part of its length. Through a region or zone 14, however, there is a somewhat enlarged and flattened section with a finger engaging surface 16 which is substantially flat and which has a complementary surface 18 on an opposite side of the needle. The surfaces 16, 18 may be engaged by fingers or by a finger and thumb of the user for manipulation of the needle in a conventional fashion.

At one end portion of the crochet needle, illustrated at a left-hand end portion thereof in FIGS. 1 and 2, a conventional crocheting hood 20 is formed for engagement with and manipulation of an elongated flexible strand of material which may comprise thread, yarn, string, etc. The hook 20 is formed integrally with the body portion 12 and is bent back upon itself so as to open generally longitudinally toward the central body portion of the needle. That is, the hook 20 has an opening or mount 22 which faces generally longitudinally rightwardly in FIGS. 1 and 2.

As thus far described, it will be apparent that the crochet needle 10 of the present invention is or may be of conventional construction and the material of construction may also take a conventional form. Plastic, bone, and metallic construction is contemplated within the scope of the invention. The needle shown and described may be regarded as formed of anodized aluminum.

In accordance with the present invention, a means for severing a flexible strand of material such as thread, yarn, etc. is provided at an end portion of the crochet needle opposite the aforesaid one or left-hand end portion bearing the conventional hook 20. A severing means is indicated generally by the reference numberal 24 in FIGS. 1 and 2 and it will be observed that a small cutting blade with a sharpened edge is provided at 26. The blade 26 is disposed within a shielding means which serves to prevent the user of the crochet needle from inadvertently injuring her hand or finger.

The shielding means may vary in form, but preferably and as illustrated, a second hook or hook-shaped element 28 is provided. The hook 28 is bent back upon itself in the manner of the hook 20 so as to open generally longitudinally toward the body portion 12 of the needle. Further, the hook 20 is preferably on a side of the needle generally opposite the hook 20 or, the hook 28 may be said to reside approximately 180° from the hook 20. Still further, the hook 28 is preferably formed integrally with the body portion 12 of the crochet needle.

An opening or mouth 30, best illustrated in FIG. 1, and formed by the hook 26 accommodates entry of a flexible strand of material for a cutting operation. The size of the mouth or opening 30, however, is small enough so as to prevent the entry of the finger or other portion of the hand of the user. As will be observed, the edge of the blade 26 is spaced somewhat rightwardly or inwardly from the mouth 30. Further, the edge of the blade 26 is shown extending in a lateral direction or approximately at 90° with respect to the longitudinal center line of the crochet needle.

The blade 26 may approximate a portion of a razor blade in construction and may be fixed in position as shown or, alternatively, provision may be made for removal and replacement thereof. That is, a slot 32 in the hook 28 may be provided so as to frictionally retain the blade in position but to permit lateral sliding movement of the blade on exertion of a predetermined force for removal and replacement.

Figure 5:
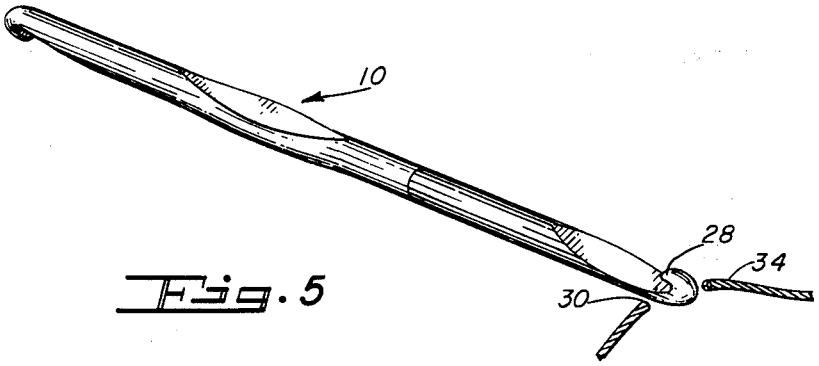
FIG. 5 is a perspective view of the improved crochet needle of FIGS. 1 and 2 in a cut off operation.

In use of the improved crochet needle of the present invention, the needle may be readily and conveniently reversed in attitude or, swung through approximately a 180° arc to engage a strand of flexible material and to sever the same. Alternatively, the material may be entered in the mouth 30 as illustrated at 34 in FIG. 5 and thereafter severed with the crochet needle held in the same position or attitude as required for crocheting. In either event, there is no necessity for placing the needle at rest and alternatively grasping and manipulating a second instrument for a cut off operation.

Further in accord with the present invention, and its presently preferred form, an indicator means is provided to prevent the user of the crochet needle from inadvertently reversing the needle and accidentally effecting a cut off operation. Such means may vary widely within the scope of the invention and may comprise merely a visual indicator as in FIGS. 1, 2 and 5. That is, an indicator means may comprise a portion of the needle adjacent the hook 28 which is distinctively different in color from the central and opposite end of the needle which bears the conventional crochet hook 20. A portion 36 of the needle 10 in FIGS. 1, 2 and 5 bears such a distinctive color extending rightwardly from a circumferential dividing line 38.

Figure 3:
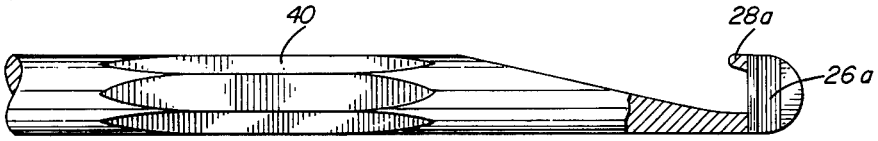
FIG. 3 is an enlarged fragmentary side elevational view of a portion of a second needle and illustrating a cut off device in partial section.

A second type of indicator means, in accordance with the present invention, may be both visually effective as well as effective to the sense of touch of the user. That is, an indicator means such as illustrated at 40 in FIG. 3 may be employed. The indicator means 40 comprises a series of flat surfaces which extend longitudinally and about the needle in an area adjacent the said opposite end portion or, the end portion bearing a hook 28*a* and a cut off blade 26*a*.

Figure 4:
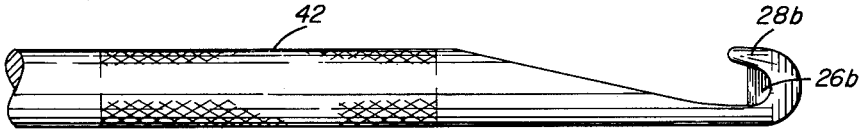
FIG. 4 is an enlarged fragmentary side elevational view of a third embodiment of a crochet needle of the present invention.

A still further form of indicator means is illustrated in FIG. 4 at 42. The indicator means 42 takes the form of a conventional knurled finish which may extend about the crochet needle adjacent a hook 28*b* which houses and conceals a cut off blade 26*b*.

I claim:

1. A crochet needle comprising an elongated body portion having a generally smooth surface for manual gripping and manipulation, a hook formed integrally at one end portion and bent back upon itself so as to open generally toward said body portion for engagement with and manipulation of an elongated flexible strand of material, and a means for severing said flexible strand of material at an end portion of said needle opposite said one end portion.

2. A crochet needle as set forth in claim 1 wherein said means for severing said flexible strand of material includes a blade having a sharpened edge.

3. A crochet needle as set forth in claim 2 wherein said means for severing said flexible strand of material includes a blade edge shielding means which prevents the user of the needle from inadvertently injuring her hand or finger.

4. A crochet needle as set forth in claim 3 wherein said shielding means includes a narrow mouth extending to the sharpened edge of the cutting blade and which is adapted to accommodate the entry of the flexible strand of material but which is too small to allow entry of the finger of the user.

5. A crochet needle as set forth in claim 4 wherein said shielding means comprises a generally hook-shaped element bent back upon itself so as to open generally toward the body portion of the needle, and wherein said cutting blade is disposed within the hook opening with its sharpened edge spaced from the mouth of the opening.

6. A crochet needle as set forth in claim 5 wherein said cutting blade is disposed with its edge substantially at 90° with respect to the longitudinal center line of the crochet needle.

7. A crochet needle as set forth in claim 1 wherein an indicator means is provided adjacent said opposite end portion of said crochet needle to prevent the user from inadvertently reversing the needle.

8. A crochet needle as set forth in claim 7 wherein said needle has an arcuate cross section and said indicator means comprises a series of flat surfaces spaced about the needle in an area adjacent said opposite end portion.

9. A crochet needle as set forth in claim 7 wherein said indicator means comprises a knurled portion of the needle disposed adjacent said opposite end portion.

10. A crochet needle as set forth in claim 7 wherein said indicator means comprises a section of said crochet needle adjacent said opposite end portion which is distinctively different in color from said one end portion and its adjacent portion.

* * * * *